United States Patent [19]

Fallier, Jr. et al.

[11] Patent Number: 4,629,945

[45] Date of Patent: Dec. 16, 1986

[54] METHOD AND APPARATUS FOR STARTING LOW WATTAGE HIGH INTENSITY DISCHARGE LAMPS

[75] Inventors: Charles N. Fallier, Jr., Westford; Joseph M. Proud, Wellesley Hills, both of Mass.

[73] Assignee: GTE Laboratories Incorporated, Waltham, Mass.

[21] Appl. No.: 686,979

[22] Filed: Dec. 27, 1984

[51] Int. Cl.[4] ..... H05B 37/00; H05B 39/00; H05B 41/14

[52] U.S. Cl. ..... 315/207; 307/106; 315/205; 315/63; 315/58; 315/289

[58] Field of Search ..... 315/205, 207, DIG. 5, 315/DIG. 7, 60, 73, 74, 43, 234, 236, 263, 289, 58, 63; 307/105, 106; 333/140

[56] References Cited

U.S. PATENT DOCUMENTS

| | | | |
|---|---|---|---|
| 2,737,612 | 3/1956 | Sims | 315/177 |
| 2,931,948 | 4/1960 | Forgacs | 315/241 |
| 3,195,031 | 7/1965 | Fitch et al. | 317/260 |
| 3,289,015 | 11/1966 | Fitch et al. | 307/110 |
| 3,432,663 | 3/1969 | Anderson et al. | 250/98 |
| 3,463,965 | 8/1969 | Peek | 315/272 |
| 3,673,423 | 6/1972 | Planas | 315/207 |
| 3,681,604 | 8/1972 | Criswell et al. | 250/98 |
| 3,963,958 | 6/1976 | Nuckolls | 315/276 |
| 4,135,114 | 1/1979 | Narikiyo | 315/47 |
| 4,137,483 | 1/1979 | Ochi et al. | 315/74 |
| 4,140,917 | 2/1979 | Weiner | 307/106 |
| 4,179,640 | 12/1979 | Larson et al. | 315/47 |
| 4,217,468 | 8/1980 | Rice et al. | 178/116 |
| 4,223,247 | 9/1980 | Jacobs et al. | 315/57 |
| 4,325,004 | 4/1982 | Proud et al. | 315/45 |
| 4,328,446 | 5/1982 | Fallier, Jr. et al. | 315/47 |
| 4,353,012 | 10/1982 | Fallier et al. | 315/289 |
| 4,379,982 | 4/1983 | Proud | 315/60 |

OTHER PUBLICATIONS

"Novel Principle of Transient High-Voltage Generation" by Fitch et al., *Proceedings IEEE*, vol. III, No. 4, Apr. 1964.

*Primary Examiner*—Saxfield Chatmon

*Attorney, Agent, or Firm*—Hamilton, Brook, Smith & Reynolds

[57] ABSTRACT

A starter circuit for metal halide discharge lamps in which a diode resistor rectifier network is provided between a conventional ballast and a spiral line generator to superimpose a D.C. voltage on the A.C. ballast voltage thereby to increase the peak instantaneous voltage to the spiral line generators and thus provide a larger breakdown voltage to the discharge lamp.

3 Claims, 5 Drawing Figures

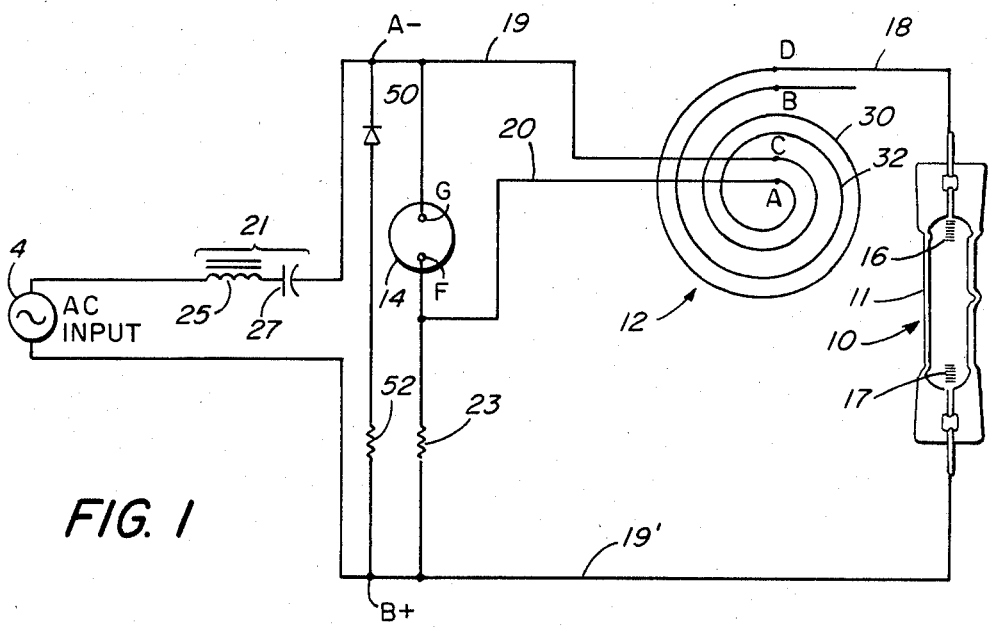
FIG. 1
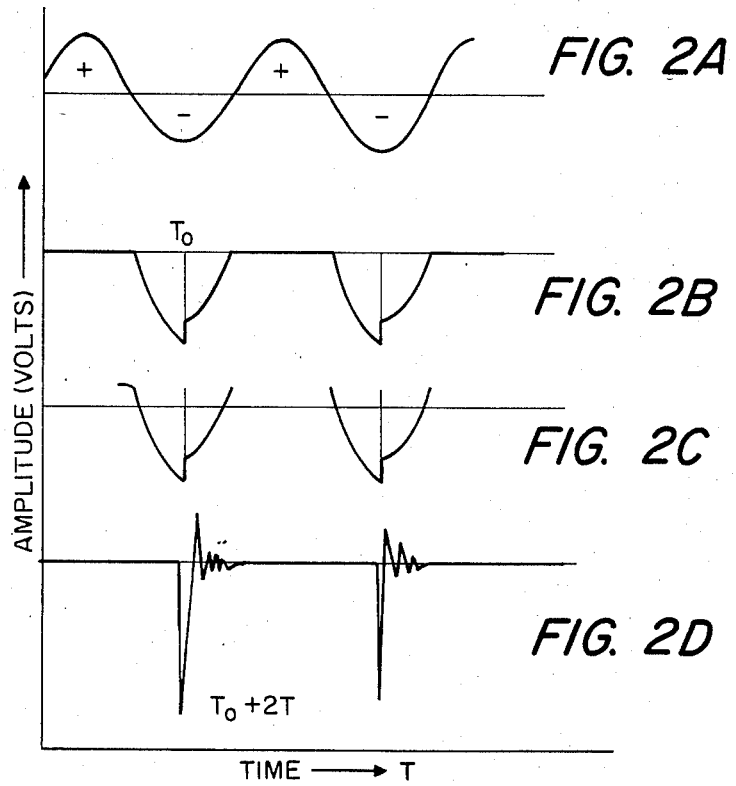

METHOD AND APPARATUS FOR STARTING LOW WATTAGE HIGH INTENSITY DISCHARGE LAMPS

DESCRIPTION

BACKGROUND ART

This invention relates to high intensity discharge lamps, more particularly, to methods and apparatus for initiation of the spark discharge in low wattage metal halide lamps which are known to be difficult to start because they require a higher starting voltage than is available from a 115 Volt line and a simple lead-lag ballast.

As described in U.S. Pat. No. 4,353,012, issued Oct. 5, 1982, conventional high intensity discharge metal halide lamps include two main electrodes at opposite ends of a discharge tube and a third starting electrode associated with one of the main electrodes. A starting circuit applies a high voltage between the main electrodes of the lamp and, simultaneously, between the starting electrode and its associated main electrode. A discharge is initiated between the starting electrode and the main electrode by the starting circuit. The discharge then transfers to provide a discharge between the two main electrodes. After a high intensity discharge is formed within the discharge tube, the voltage between the electrodes drops and the starting circuit is no longer operative.

While the starting electrode in metal halide lamps provides generally satisfactory operation, it has certain disadvantages. The complexity and cost of manufacturing the lamp are increased when the starting electrode is used. In addition, the lamp seal in the region of the starting electrode is adversely affected by an electrolysis process when a potential difference exists between the starting electrode and the main electrode. The degradation of the seal can eventually lead to lamp failure. It is known that this problem can be alleviated by connecting a thermal switch, which closes after starting of the lamp, between the main electrode and the starting electrode. However, the thermal switch adds to the overall cost and complexity of the lamp assembly. It is, therefore, desirable to provide a starting arrangement for metal halide lamps wherein the starting electrode can be eliminated.

The spiral line pulse generator, disclosed by R. A. Fitch et al. in U.S. Pat. No. 3,289,015, issued Nov. 29, 1966, is a device capable of storing electrical energy and, upon momentary short circuiting of a pair of terminals, of providing a high amplitude pulse. The spiral line pulse generator can, when properly utilized, provide the dual functions of storage and voltage multiplication. The spiral line pulse generator is a transient field reversal device which provides a roughly triangular pulse. Its peak voltage is a multiple of the initial charging voltage. The use of a spiral line pulse generator to start high pressure sodium lamps is disclosed in U.S. Pat. No. 4,325,004 issued April 13, 1982 and assigned to the assignee of the present application. The output of the spiral line pulse generator is coupled to a conductor, or starting aid, located in close proximity to an outer surface on the central portion of the discharge tube. In the case of metal halide lamps, it has been found undesirable to locate conductors in close proximity to the central portion of the discharge tube, thereby ruling out the use of such a starting aid to assist in initiating discharge.

U.S. Pat. No. 4,353,012 issued Oct. 5, 1982 shows a starting circuit for high intensity discharge metal halide lamps which includes a spiral line pulse generator including two conductors and two insulators, each in the form of an elongated sheet, in an alternating and overlapping arrangement which is rolled together in a spiral configuration having a plurality of turns. The spiral line pulse generator includes an output terminal coupled to one of the electrodes of the lamp and a pair of input terminals. One of the input terminals and the other of the electrodes of the lamp are adapted for coupling to a source of lamp operating power and for delivering lamp operating power, received from the source, through the spiral line pulse generator to the discharge lamp. The starting circuit also includes a spark gap for applying a voltage between the conductors of the spiral line pulse generator and for switching the conductors from a first voltage to a second voltage in a time interval much shorter than the transit time of electromagnetic waves through the spiral line pulse generator. After operation of the switch, the spiral line pulse generator provides, at its output terminal, a high voltage, short duration pulse of sufficient energy to initiate discharge in the discharge lamp.

While the starting circuit described in U.S. Pat. No. 4,353,012 is suitable for the purposes intended, its performance could be improved substantially if greater voltage output could be applied to the lamp electrodes, producing a higher breakdown voltage and, thus, more reliable starting.

SUMMARY OF THE INVENTION

In accordance with the present invention, a series connected diode and resistor circuit is coupled between the conventional ballast and the spiral line generator of the '012 patent. The diode rectifies the A.C. ballast power to produce a half-wave pulse which is superimposed on the ballast voltage. This added voltage is applied through the resistor to the spark gap. Because the voltage applied to the spark gap is greater than that obtained from a conventional ballast, the spark gap can now be operated at a greater potential. The pulse generated by the spiral line is therefore increased by the same factor. This results in greatly improved reliability in the starting of such devices.

BRIEF DESCRIPTION OF THE DRAWINGS

FIG. 1 is a simplified schematic diagram of a preferred embodiment of a spiral line pulse generator circuit in accordance with the invention;

FIG. 2A–D are graphic representation of voltage waveforms at various points in the circuit of FIG. 1;

For a better understanding of the present invention, together with other and further objects, advantages and capabilities thereof, reference is made to the following disclosure and appended claims in connection with the above-described drawings.

BEST MODE OF CARRYING OUT THE INVENTION

A high intensity light source circuit, in accordance with the invention, is shown in FIG. 1 to comprise in general a ballast 21, a spiral line generator 12, and a lamp 10. Ballast 21 is connected to a source of AC power 4. Typically, power source 4 is at line voltage of 110 Volts AC. Ballast 21 normally comprises a series choke or inductor 25 and capacitor 27 to form a lead-lag circuit with approximately unity power factor. Inductor 25 may also be an auto-transformer to step up the line voltage. The spiral line generator 12 is of the type described in detail in U.S. Pat. No. 4,353,012. Generator 12 comprises a pair of conductors 30 and 32 in the form of elongated sheets of conductive material separated by a dielectric (not shown) rolled together to form a multiple turn spiral configuration.

The ballast 21 is coupled via line 19 to input point C of conductor 30 of spiral line generator 12. Line 19' couples the common side of the AC power to electrode 17 of high intensity discharge lamp 10.

A spark gap switch 14, such as a type supplied by C. P. Clare division of General Instruments Corporation is coupled in series with a charging resistor 23 across the lines 19 and 19' between the ballast 21 and the line generator 12. Spark gap electrode F is connected to input point A of generator conductor 32 of generator 12 via lead 20.

Output point D of conductor 30 is coupled via lead 18 to electrode 16 sealed within the envelope 11 of high intensity discharge lamp 10. Lamp 10 is preferably a metal halide discharge lamp having an envelope 11 enclosing a fill material, such as metal halide, which emits light during discharge.

Output point B of generator 12 is not conductively coupled but, rather, is capacitively coupled to conductive line 18, such that the voltage pulses produced in generator 12, as the spark gap 14 is switched from an open circuit to a short circuit on each alternate half cycle of the A.C. power input voltage is coupled into lead 18 to create a voltage difference across electrodes 16 and 17 to produce a discharge in the lamp 10.

The A.C. voltage shown in FIG. 2A from ballast 21 is substantially increased by the addition of the diode 50 and resistor 52 across the ballast, as shown in FIG. 1 at points A and B. Diode 50 conducts from common or point B+ through resistor 52 to point A− when the polarity of the A.C. ballast voltage is negative (as shown in the second half of the curve of FIG. 2A). Thus, a voltage is developed across resistor 52 on negative swings of the ballast voltage. This, resulting half wave signal (FIG. 2B) is superimposed on the A.C. ballast voltage between A and B to produce the voltage waveform shown in FIG. 2C* which is applied to spark gap 14 across terminals G and F and resistor 23. Since the voltage across the spark gap 14 is increased by the diode-resistor rectifier circuit across the ballast, the spark gap 14 may be selected to have a larger breakdown voltage than would typically be employed. The predetermined firing voltage of the spark gap is selected to be somewhat lower than the peak A.C. voltage, but higher than the normal discharge voltage of lamp 10, so that spiral line generator 12 can supply a high energy pulse to electrode 16 of discharge lamp 10.

In operation, the A.C. output voltage of the ballast 21 is applied between the input lead 19 of the spiral line pulse generator 12 and the electrode 17 of the discharge lamp 10. The A.C. output voltage of the ballast 21 is also applied to the input terminal 19 and through the resistor 23 to the input lead 20 of the spiral line pulse generator 12. Referring now to FIG. 2B, the voltage across the spiral line pulse generator 12 is rectified by diode 50 during the positive swing. During the negative swing the voltage decreases until the firing voltage of the spark gap 14 is reached at time $T_0$. The spark gap rapidly short circuits the spiral line pulse generator 12 and a high voltage, short duration pulse, illustrated in FIG. 2D, is provided at the output of the spiral line pulse generator 12 at time $T_0+2t$, as described hereinabove. By repetition of this process, a high voltage pulse is produced by the spiral line pulse generator 12 on each negative half cycle of the A.C. input voltage, as shown in FIG. 2D, until a discharge is initiated at the discharge lamp 10. After a discharge is established in the discharge lamp 10, the voltage supplied by the lamp ballast 21 is reduced to the normal discharge voltage of lamp 10, which is below the spark gap's firing voltage, so that the spark gap 14 does not fire. Lamp operating power from the ballast 21 is then supplied through the spiral line pulse generator 12 to the discharge lamp 10.

Thus, there is provided by the present invention a light source wherein a metal halide discharge lamp can be reliably started and operated without a requirement for a starting electrode. The manufacturing cost of the discharge lamp without a starting electrode is reduced and the reliability of the discharge lamp is improved. The starting circuit can be enclosed in the lamp base of a light source of conventional configuration. Thus, the light source described herein can directly replace conventional light sources.

Equivalents

While there has been shown and described what is at present considered the preferred embodiment of the invention, it will be obvious to those skilled in the art that various changes and modifications may be made therein without departing from the scope of the invention as defined by the appended claims.

What is claimed is:

1. A light source comprising:

(a) a high intensity discharge lamp including a discharge tube having first and second electrodes sealed therein at opposite ends and an envelope enclosing a fill material which emits light during discharge;

(b) a ballast means for providing an output A.C. voltage across first and second terminals equal to or substantially greater than the voltage into said ballast means, adapted to be conductively coupled to a source of AC voltage;

(c) a spark gap switch having first and second electrodes and a resistor coupled in series across the output terminals of said ballast means such that the first electrode of the spark gap means is conductively coupled to the first output terminal of said ballast means;

(d) a starting circuit including:

(i) a spiral line pulse generator including two conductors insulated from each other and formed together in a spiral configuration having a plurality of turns;

(ii) said spiral line pulse generator having a first one of said conductors conductively coupled at a first end to the second electrode of said spark gap and a second end left non-conductively coupled, and the second one of said conductors having a first end conductively coupled to the first electrode of said spark gap, and a second end conductively coupled to said first electrode of the discharge lamp;

(iii) and a diode and resistor coupled in series at one end to the first electrode of the spark gap and at the remaining end to the second electrode of the discharge lamp and second terminal of the ballast means.

2. The light source of claim 1 wherein the discharge lamp is a metal halide discharge lamp.

3. A starting circuit for a two electrode discharge lamp comprising ballast means for supplying A.C. voltage, a spark gap switch in series with a resistor coupled across said ballast means, a spiral line pulse generator including a pair of spiral conductors wound adjacent each other for storing energy from said ballast means and rectifier means for superimposing a D.C. voltage on said A.C. voltage, said generator being coupled across said electrodes and said rectifier means comprising a diode and resistor coupled in series with each other and in parallel with said spark gap switch and resistor and one of said conductors of the generator being coupled to one side of the spark gap with the other conductor being coupled to the other side.

* * * * *